US006928698B2

(12) United States Patent
Chen et al.

(10) Patent No.: US 6,928,698 B2
(45) Date of Patent: Aug. 16, 2005

(54) LIFT-UP HINGE DEVICE OF MULTIFUNCTION PERIPHERAL

(75) Inventors: Peng-Yu Chen, Taipei (TW); Ping-Hong Kuo, Taipei (TW)

(73) Assignee: Primax Electronics, LTD. (TW)

( * ) Notice: Subject to any disclaimer, the term of this patent is extended or adjusted under 35 U.S.C. 154(b) by 58 days.

(21) Appl. No.: 10/617,509

(22) Filed: Jul. 11, 2003

(65) Prior Publication Data

US 2004/0143934 A1 Jul. 29, 2004

(30) Foreign Application Priority Data

Jan. 24, 2003 (TW) ..... 92101540 A

(51) Int. Cl.[7] ..... E05F 1/08
(52) U.S. Cl. ..... 16/277; 16/335
(58) Field of Search ..... 16/277, 335, 284, 16/285, 322, 325, 352, 255, 308, DIG. 34, 280–282, 359, 361, 366, 371

(56) References Cited

U.S. PATENT DOCUMENTS 4,069,547 A * 1/1978 Guionie et al. ..... 16/323
4,117,569 A * 10/1978 Lautenschlager et al. ..... 16/287
4,236,272 A * 12/1980 Gronbach et al. ..... 16/288
4,251,900 A * 2/1981 Lautenschlager ..... 16/294
4,424,606 A * 1/1984 Sorimachi ..... 16/223
4,660,251 A * 4/1987 Watabe ..... 16/367
4,771,507 A * 9/1988 Draplin et al. ..... 16/297
5,926,917 A * 7/1999 Gantz ..... 16/334
5,971,514 A * 10/1999 Hayakawa ..... 312/319.2
6,401,299 B1 * 6/2002 Schwarz ..... 16/335
6,497,004 B1 * 12/2002 Armstrong ..... 16/66
6,530,122 B1 * 3/2003 Kondou et al. ..... 16/335
6,574,835 B2 * 6/2003 Melhuish ..... 16/282
6,684,456 B2 * 2/2004 Lee ..... 16/342
6,766,563 B2 * 7/2004 Lee ..... 16/286

FOREIGN PATENT DOCUMENTS

DE 3638577 A1 * 5/1998

* cited by examiner

*Primary Examiner*—Robert J. Sandy
*Assistant Examiner*—Andre' L. Jackson
(74) *Attorney, Agent, or Firm*—Madson & Metcalf

(57) ABSTRACT

A lift-up hinge for pivotally connecting a first portion and a second portion of an appliance includes a fixture member, a first movable member and a second movable member. The fixture member is secured on the first portion of the appliance. The first movable member is pivotally coupled to a first pivot point of the fixture member and having thereon a resilient element. The second movable member has a first end lying on the resilient element, a second end secured on the second portion of the appliance, and a third end pivotally coupled to a second pivot point of the fixture member. The second movable member transmits the first movable member to pivot about the first pivot point of the fixture member when the second portion of the appliance is pivoted about the second pivot point of the fixture member.

17 Claims, 7 Drawing Sheets

LIFT-UP HINGE DEVICE OF MULTIFUNCTION PERIPHERAL

FIELD OF THE INVENTION

The present invention relates to a lift-up hinge device, and more particularly to a lift-up hinge device of a multifunction peripheral.

BACKGROUND OF THE INVENTION

With increasing power of personal computers, a diversity of peripheral devices can be employed with the personal computers to achieve various purposes. The diverse peripherals, however, occupy lots of space and I/O ports of a computer. A multifunction peripheral having multiple functions in one structural unit is thus developed, for example the functions of a printer, a scanner, and optionally a fax machine and/or a copy machine. FIG. 1 is a side view schematically showing a multifunction peripheral. The multifunction peripheral 1 comprises a scanner portion 10 and a printer portion 11. A hinge device 12 is arranged between the scanner portion 10 and the printer portion 11. By pivoting up the scanner portion 10 about the hinge device 12, the printer portion 11 can be exposed to replace the cartridge accommodated in the printer portion 11 or remove a stuck paper. The hinge device 12 not only serves a pivoting fulcrum but also provides a lift-up force to facilitate the pivoting operation. The mechanism of the hinge device 12 will be described hereinafter with reference to FIG. 2.

As shown in FIG. 2, the hinge device 12 comprises a connecting portion 22 screwed to the printer portion 11. The scanner portion 10 is connected to the connecting portion 22 and pivotal about the fulcrum 21. The hinge device 12 also comprises an auxiliary spring 20 urging against between the connecting portion 22 and a cover portion of the multifunction peripheral, i.e. the scanner portion 10. The recovering force to spontaneously recover itself to a released or uncompressed state provides an auxiliary force to help lift the scanner portion 10 up. For example, when the spring 20 is recovered to its original released or uncompressed state, the scanner portion 10 is lifted upright. From the above description, it is inherent that when the scanner portion 10 is at a closed position lying on the printer portion 11, which indicates a normal operational state of the multifunction peripheral and is so for most time, the spring 20 is compressed. Meanwhile, the compressed spring 20 imparts an urging force against the connecting portion 22. Comparable to the auxiliary force for lifting up the scanner portion, the urging force of the spring against the connecting portion 22 is also strong. Therefore, the associated components are subject to being loosened or even stripped.

SUMMARY OF THE INVENTION

It is an object of the present invention to provide a lift-up hinge device of a multifunction peripheral, which provides an auxiliary force to pivotally lift up the scanner portion to the open position, and keeps the scanner portion at the closed position exempting from any undesirable urging force.

In accordance with a first aspect of the present invention, there is provided a lift-up hinge for pivotally connecting a first portion and a second portion of an appliance. The lift-up hinge comprises a fixture member, a first movable member and a second movable member. The fixture member is secured on the first portion of the appliance. The first movable member is pivotally coupled to a first pivot point of the fixture member and having thereon a track and a resilient element. The second movable member has a first end lying on the resilient element and movable along the track, a second end secured on the second portion of the appliance, and a third end pivotally coupled to a second pivot point of the fixture member. The first end of the second movable member moves along the track of the first movable member toward the first portion of the appliance to urge against the resilient element when the second portion of the appliance is pivoted to cover the first portion of the appliance. Whereas, the first end of the second movable member moves along the track of the first movable member toward the second portion of the appliance to release the resilient element when the second portion of the appliance is pivoted to exposed the first portion of the appliance.

In an embodiment, the appliance is a multifunction peripheral.

In an embodiment, the first and the second portions are a printer and a scanner portions of the multifunction peripheral.

In an embodiment, the resilient element is a spring.

In an embodiment, the second movable member transmits the first movable member to pivot about the first pivot point of the fixture member when the second portion of the appliance is pivoted about the second pivot point of the fixture member.

In an embodiment, the first movable portion pivots about the first pivot point of the fixture member to result in a first angle between the first and the second movable members being 180 degrees when the second portion of the appliance is pivoted about the second pivot point of the fixture member to cover the first portion of the appliance.

In an embodiment, the first angle between the first and the second movable portions is decreasing during the operation that the second portion of the appliance is pivoted about the second pivot point of the fixture member to expose the first portion of the appliance.

Preferably, a second angle between the first movable member and a surface of the first portion is no greater than 90 degrees.

In accordance with a second aspect of the present invention, there is provided a lift-up hinge for pivotally connecting a first portion and a second portion of an appliance. The lift-up hinge comprises a fixture member, a first movable member and a second movable member. The fixture member is secured on the first portion of the appliance. The first movable member is pivotally coupled to a first pivot point of the fixture member and having thereon a resilient element. The second movable member has a first end lying on the resilient element, a second end secured on the second portion of the appliance, and a third end pivotally coupled to a second pivot point of the fixture member. The second movable member transmits the first movable member to pivot about the first pivot point of the fixture member when the second portion of the appliance is pivoted about the second pivot point of the fixture member.

In an embodiment, the first movable member further has thereon a track and the first end of the second movable member is movably engaged with the track.

In an embodiment, the first end of the second movable member moves along the track of the first movable member toward the first portion of the appliance to urge against the resilient element when the second portion of the appliance is pivoted to cover the first portion of the appliance, and the first end of the second movable member moves along the track of the first movable member toward the second portion of the appliance to release the resilient element when the second portion of the appliance is pivoted to expose the first portion of the appliance.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
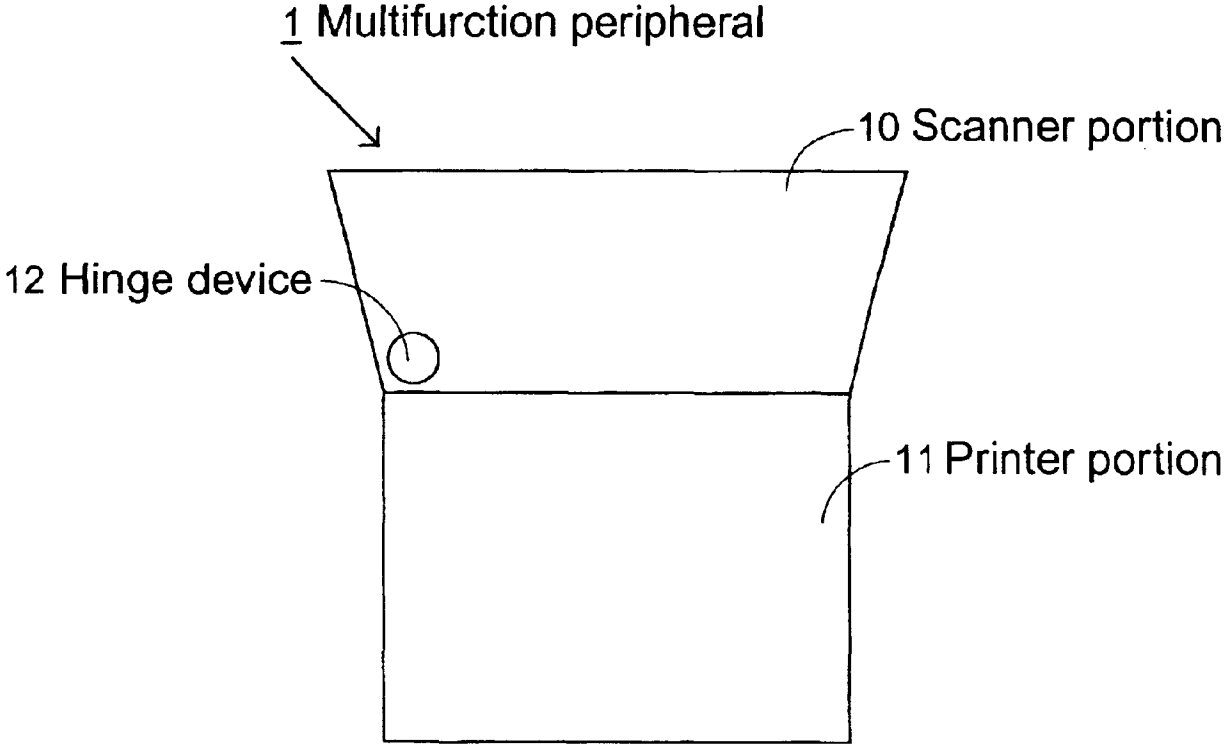
Fig.1 PRIOR ART
FIG. 1 is a side view schematically showing a typical multifunction peripheral.
Figure 2:
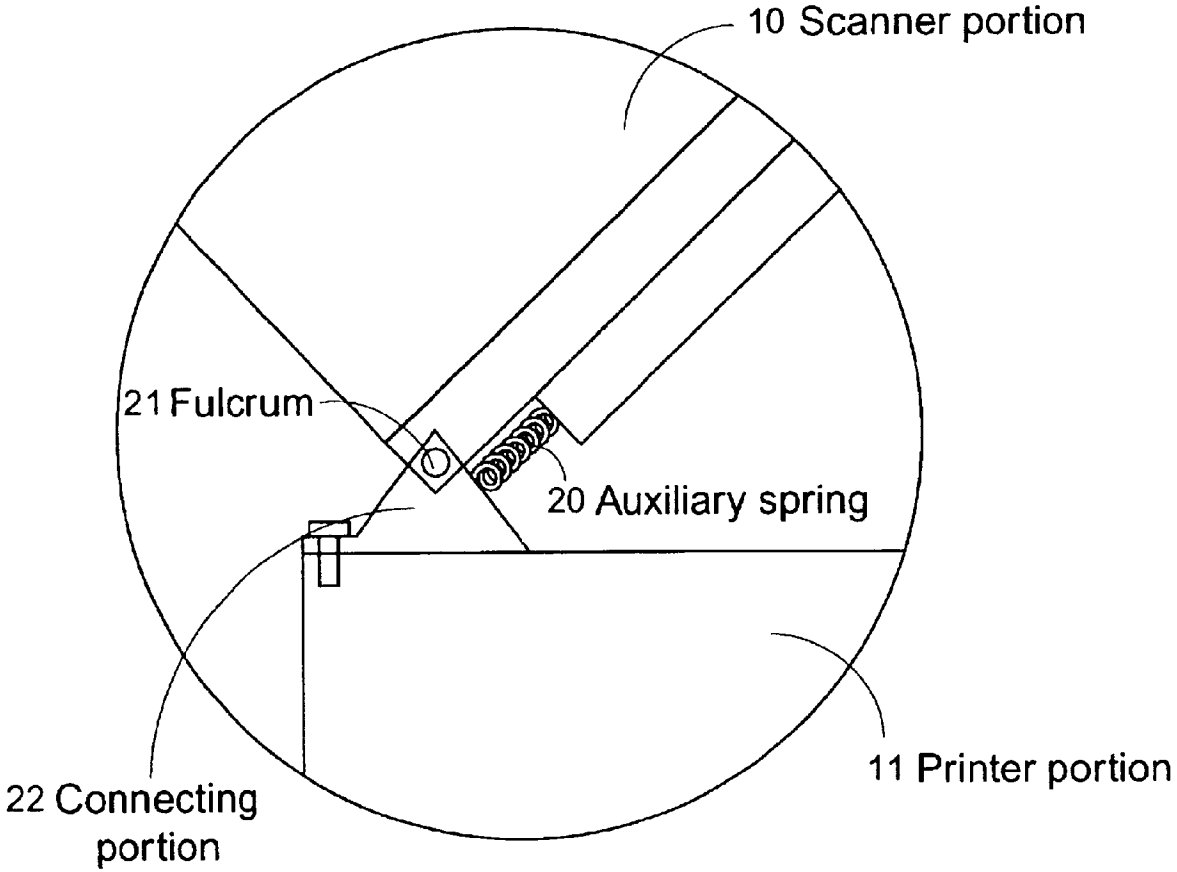
Fig.2 PRIOR ART
FIG. 2 is an enlarged view schematically shows the structure of a conventional hinge device for use in a multifunction peripheral.
Figure 3:
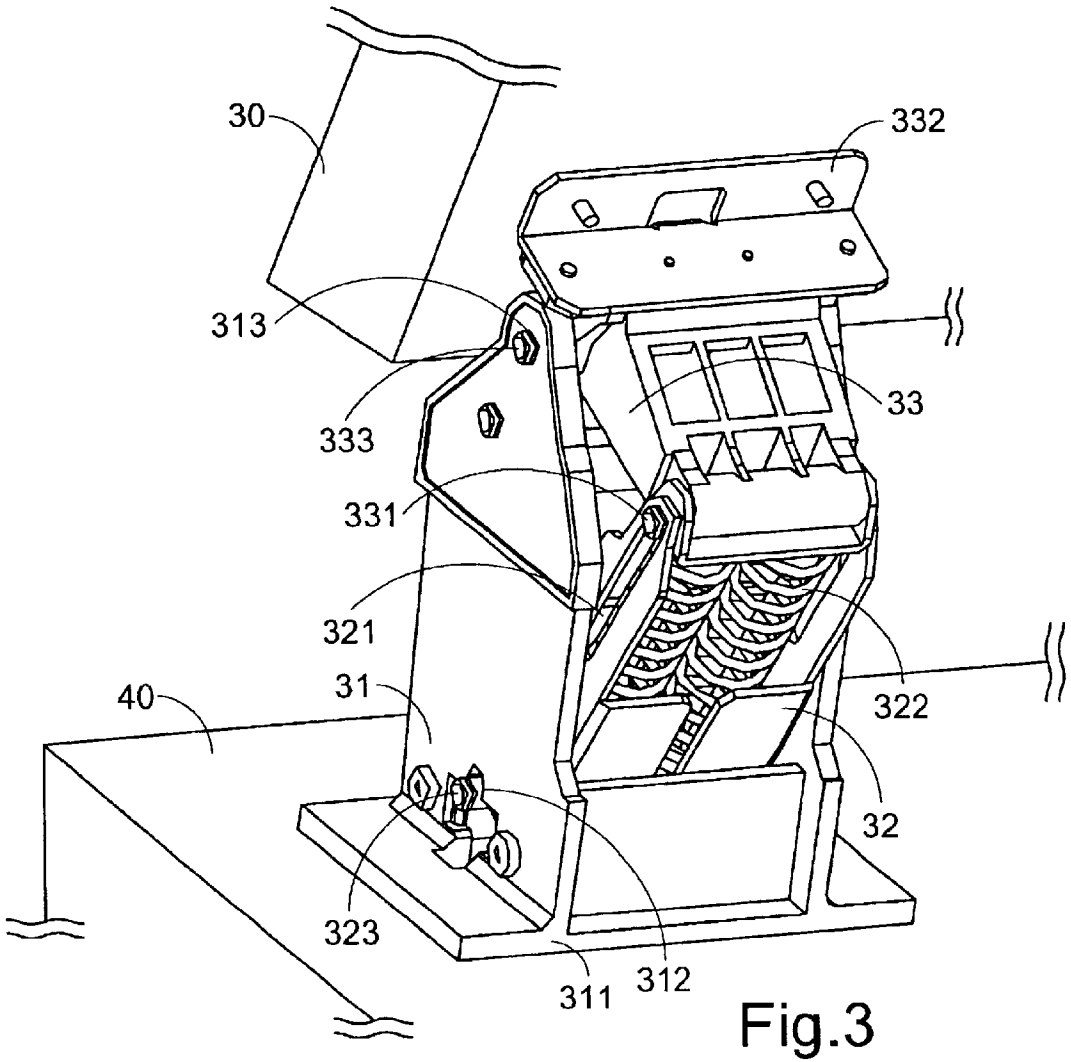
FIG. 3 is a perspective view illustrating the configuration of a lift-up hinge device when the scanner portion is pivoted to the open position according to a preferred embodiment of the present invention.
Figure 4:
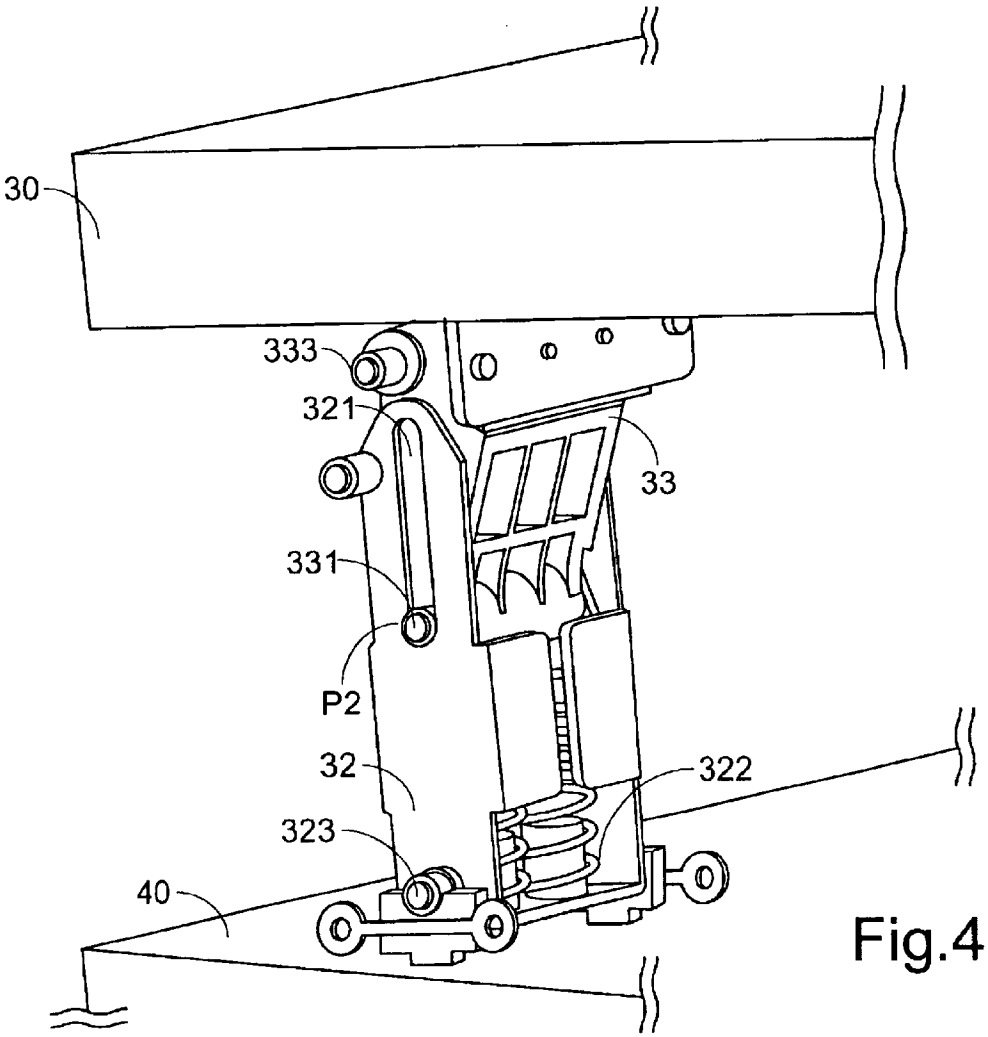
FIG. 4 is a perspective view illustrating the configuration of the lift-up hinge device of FIG. 3 when the scanner portion of the multifunction peripheral is pivoted to cover the printer portion.

Please refer to FIGS. 3 and 4. A lift-up hinge device of a multifunction peripheral is arranged between a printer portion 40 and a scanner portion 30 for allowing said scanner portion to be pivoted to expose or cover the printer portion, and principally comprises a fixture member 31, a first movable member 32 and a second movable member 33.

The bottom surface 311 of fixture member 31 is secured on the printer portion 40 of the multifunction peripheral. The first movable member 32 is pivotally coupled to a first pivot point 312 of the fixture member 31, and has thereon a track 321 and a resilient element 322 such as a spring. The second movable member 33 has a first end 331 lying on the resilient element 322 and movable along the track 321 of the first movable member 32. The second end 332 of the second movable member 33 is secured on the scanner portion 30 of the multifunction peripheral. The second movable member 33 further has a third end 333 pivotally coupled to a second pivot point 313 of the fixture member 31.

When a user exerts a force to open the scanner portion 30, the second movable member 33 rotates counterclockwise about the second pivot point 313, and the first end 331 of the second movable member 33 moves along the track 321 of the first movable member 32 toward the scanner portion 30 to expose the printer portion 40, as shown in FIG. 3. On the other hand, when the second movable member 33 rotates clockwise due to the user's operation to close the scanner portion 30, the first end 331 of the second movable member 33 moves along the track 321 of the first movable member 32 toward the printer portion 40 until a position P2 is reached so as to cover the scanner portion 30 of the multifunction peripheral, as can be seen in FIG. 4. For easy observation, the fixture member 31 is omitted from the drawing.

Figure 5A:
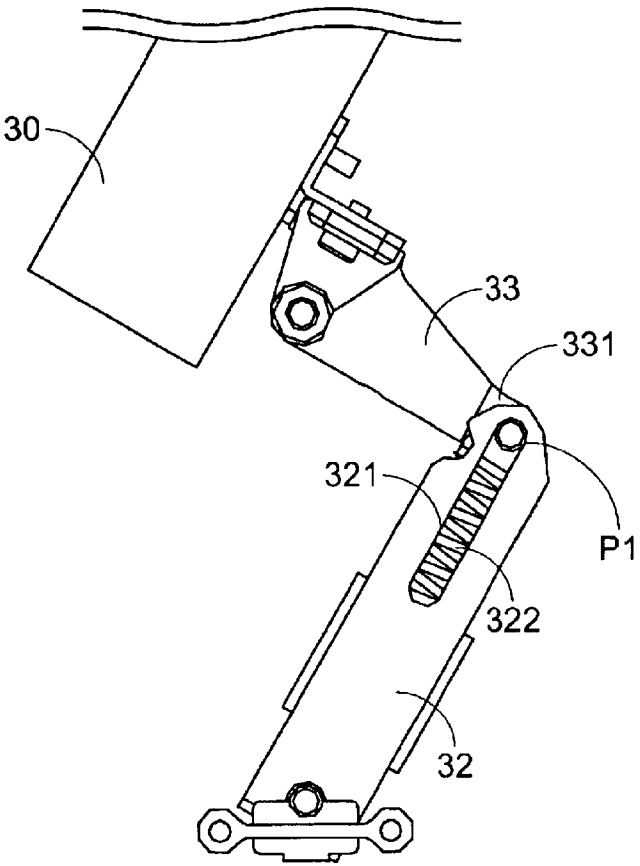
FIGS. 5(*a*)~5(*c*) are side views schematically illustrate the configure change of the lift-up hinge device switched from an open position to a closed position.
Figure 5B:
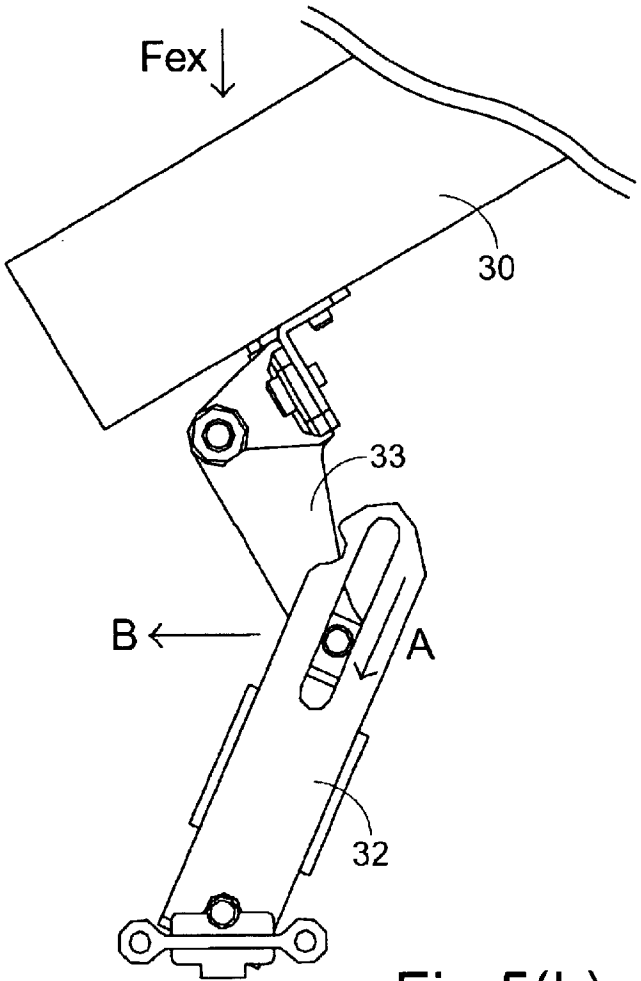
Figure 5C:
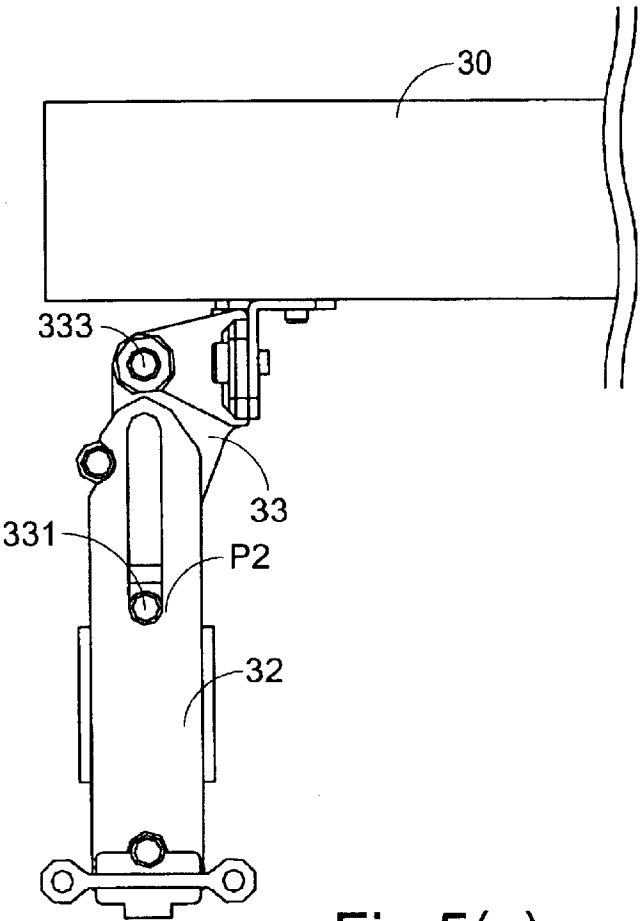

During the moving up process of the first end 331 of the second movable member 33 along the track 321, as shown from FIG. 5(*c*) to FIG. 5(*a*), the resilient element 322 is changing from a compressed state to a released state, thereby providing a recovery force against the second movable member 33. Since the recovering force of the resilient element 322 shares the weight of the scanner portion 30, only a small external force is required to lift up the scanner portion 30 to its open position. On the other hand, during the moving down process of the first end 331 of the second movable member 33 along the track 321, as shown from FIG. 5(*a*) to FIG. 5(*c*), the resilient element 322 is changing from the released state to the compressed state. Finally, the second movable member 33 is vertically aligned with the first movable member 32 so as to normally urge against the resilient element 322. Due to the urging force is exerted normally, no element will be subject to any pushed-away force. Therefore, the problem of loosening or stripping off components in the prior art can be effectively overcome The mechanisms of the lift-up hinge device can be illustrated in more details as follows. Please refer to FIGS. 5(*a*) to 5(*c*), which schematically illustrates operations of the lift-up hinge device switched from an open position to a closed position according to the present invention. In FIG. 5(*a*), the scanner portion 30 of the multifunction peripheral is lifted up to an open position, and thus transmits the first end 331 of the second movable member 33 to the position P1 along the track 321. Meanwhile, the first movable member 32 is deviated from the surface of the printer portion by an angle of approximately 60 degrees. Then, as shown in FIG. 5(*b*), with an external force Fex acting downwards onto the scanner portion 30, the second movable member 33 rotates clockwise so as to be forced to move downward as indicated by the arrow A and pulled backward as indicated by the arrow B. Afterwards, the configuration of the hinge device as shown in FIG. 5(*c*) is rendered. The first end 331 of the second movable member 33 is switched to the position P2 of the track 321 when the printer portion 40 is completely covered by the scanner portion 30. Meanwhile, the included angle between the first movable member 32 and the second movable member 33 is substantially 180 degrees.

From the above description, it is understood that the lift-up hinge device of the present invention can provide an auxiliary force to pivotally lift up the scanner portion to the open position. In addition, the urging force of the spring is linearly restrained in the track and has essentially no effect on the related components of the lift-up hinge device. Therefore, the problem of resulting in loosened or stripped components in the prior art can be effectively overcome.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A lift-up hinge for pivotally connecting a first portion and a second portion of an appliance, comprising:

a fixture member secured on said first portion of said appliance;

a first movable member pivotally coupled to a first pivot point of said fixture member and having thereon a resilient element; and a second movable member having a first end lying on said resilient element, a second end secured on said second portion of said appliance, and a third end pivotally coupled to a second pivot point of said fixture member, wherein said second movable member transmits said first movable member to pivot about said first pivot point of said fixture member when said second portion of said appliance is pivoted about said second pivot point of said fixture member, and said resilient element is urged between said first and second pivot points when said second portion of said appliance is pivoted to cover said first portion of said appliance.

2. The lift-up hinge according to claim 1 wherein said first movable portion pivots about said first pivot point of said fixture member to result in a first angle between said first and said second movable members being 180 degrees when said second portion of said appliance is pivoted about said second pivot point of said fixture member to cover said first portion of said appliance.

3. The lift-up hinge according to claim 2 wherein said first angle between said first and said second movable portions is decreasing during the operation that said second portion of said appliance is pivoted about said second pivot point of said fixture member to expose said first portion of said appliance.

4. The lift-up hinge according to claim 1 wherein a second angle between said first movable member and a surface of said first portion is no greater than 90 degrees.

5. The lift-up hinge according to claim 4 wherein said first movable member further has thereon a slot track and said first end of said second movable member is movably engaged with said track.

6. The lift-up hinge according to claim 5 wherein said first end of said second movable member moves along said slot track of said first movable member toward said first portion of said appliance to urge said resilient element against said first portion of said appliance when said second portion of said appliance is pivoted to cover said first portion of said appliance, and said first end of said second movable member moves along said slot track of said first movable member toward said second portion of said appliance to release said resilient element when said second portion of said appliance is pivoted to expose said first portion of said appliance.

7. The lift-up hinge according to claim 1 wherein said resilient element is a spring.

8. The lift-up hinge according to claim 1 wherein said appliance is a multifunction peripheral.

9. The lift-up hinge according to claim 8 wherein said first and said second portions are a printer and a scanner portions of said multifunction peripheral.

10. A lift-up hinge for pivotally connecting a first portion and a second portion of an appliance, comprising:

a fixture member secured on said first portion of said appliance;

a first movable member pivotally coupled to a first pivot point of said fixture member and having thereon a slot track and a resilient element; and a second movable member having a first end lying on said resilient element and movable inside said slot track, a second end secured on said second portion of said appliance, and a third end pivotally coupled to a second pivot point of said fixture member, wherein said first end of said second movable member moves along said slot track of said first movable member toward said first portion of said appliance to urge said resilient element against said first portion of said appliance when said second portion of said appliance is pivoted to cover said first portion of said appliance, and said first end of said second movable member moves along said slot track of said first movable member toward said second portion of said appliance to release said resilient element when said second portion of said appliance is pivoted to expose said first portion of said appliance.

11. The lift-up hinge according to claim 10 wherein said appliance is a multifunction peripheral.

12. The lift-up hinge according to claim 11 wherein said first and said second portions are a printer and a scanner portions of said multifunction peripheral.

13. The lift-up hinge according to claim 10 wherein said resilient element is a spring.

14. The lift-up hinge according to claim 10 wherein said second movable member transmits said first movable member to pivot about said first pivot point of said fixture member when said second portion of said appliance is pivoted about said second pivot point of said fixture member.

15. The lift-up hinge according to claim 14 wherein said first movable portion pivots about said first pivot point of said fixture member to result in a first angle between said first and said second movable members being 180 degrees when said second portion of said appliance is pivoted about said second pivot point of said fixture member to cover said first portion of said appliance.

16. The lift-up hinge according to claim 15 wherein said first angle between said first and said second movable portions is decreasing during the operation that said second portion of said appliance is pivoted about said second pivot point of said fixture member to expose said first portion of said appliance.

17. The lift-up hinge according to claim 14 wherein a second angle between said first movable member and a surface of said first portion is no greater than 90 degrees.

* * * * *